United States Patent [19]

Schneider et al.

[11] Patent Number: 4,680,841

[45] Date of Patent: Jul. 21, 1987

[54] ELECTRICAL HARNESS FABRICATION APPARATUS

[75] Inventors: Thomas E. Schneider, Burbank; Clarence Kolanowski, LaGrange; Richard L. Patterson, Riverside, all of Ill.

[73] Assignee: Molex Incorporated, Lisle, Ill.

[21] Appl. No.: 745,171

[22] Filed: Jun. 17, 1985

[51] Int. Cl.[4] ..... H01R 43/04

[52] U.S. Cl. ..... 29/33 M; 29/33 J; 29/36; 29/749; 29/785

[58] Field of Search ..... 29/33 M, 564.1, 33 J, 29/36, 749, 785, 786

[56] References Cited

U.S. PATENT DOCUMENTS

| | | | |
|---|---|---|---|
| 4,238,875 | 12/1980 | Van Sickle | 29/785 |
| 4,263,708 | 4/1981 | Takahishi et al. | 29/564.1 |
| 4,367,575 | 1/1983 | Forster et al. | 29/33 M |
| 4,580,340 | 4/1986 | Shields | 29/749 X |

*Primary Examiner*—Z. R. Bilinsky

*Attorney, Agent, or Firm*—Louis A. Hecht; John W. Cornell

[57] ABSTRACT

Disclosed is an apparatus for fabricating cable harness assemblies of the type wherein a plurality of mating pairs of electrical connector parts are terminated to a continous flat cable segment. Termination includes compressing a predetermined cable portion between a pair of connector parts, one of which has a plurality of insulation displacing terminals positioned therein. The connector parts are transported between loading stations and a termination station, by connector holders mounted on a pair of opposed rotatable indexing turrets. At least one of the connector holders is advanced inwardly toward the termination station, so as to bring the two connector parts together in compression, after a cable segment is located therebetween.

Thereafter, the cable is advanced to bring another predetermined portion to the termination station, while the turrets are indexed to present a second pair of opposed mating parts to the termination station. Simultaneously therewith fresh connector parts are loaded into empty connector holder locations. Upon completion of a harness assembly, the turrets are rotated so as to present a pair of opposed cable cutting fixtures at the termination station, and upon a similar compression stroke, the cable harness is cut free for transport to a remote location.

16 Claims, 6 Drawing Figures

ELECTRICAL HARNESS FABRICATION APPARATUS

BACKGROUND OF THE INVENTION

1. Field of the Invention

This invention pertains to apparatus for fabricating a plurality of electrical harnesses. Each harness includes a connector defined by a two-part housing with one part having insulation displacement type terminals loaded therein, connected to an insulation clad wire, preferably a wire of the flat ribbon cable type. More particularly, the present invention relates to apparatus for producing sets of electrical harnesses defined by cable segment terminated to a plurality of electrical connectors, commonly termed "daisy-chain" harnesses.

2. Brief Description of the Prior Art

Manufacturers of electronic products are relying on electrical harnesses employing insulation displacement type contacts to avoid many of the inefficiences and costs associated with other types of electrical connections. A typical electrical harness that is now widely accepted includes a mass termination connector with a two-part housing in which one part has insulation displacement type terminals positioned therein. Some or all of the terminals are electrically connected to insulation clad wires of either the discrete wire type, or wires joined together in a unitary flat cable construction.

One example of a mass termination insulation displacement type connector is described in U.S. Pat. No. 4,410,222 assigned to the assignee of the present invention. The electrical connector assembly is comprised of two parts which, when telescopically mated one with another, form a termination with a multiconductor flat ribbon cable. Termination of the cable is accomplished by inserting the cable between a first connector part containing a plurality of insulation displacement terminals, and a second connector part comprising a mating cover which assists in the alignment of the flat cable with respect to the insulation displacing terminals. Compression of the two connector parts causes insertion of the several conductors of the flat cable in the insulation displacing terminals of the first connector part.

While the aforementioned patent describes a particular connector assembly having a third strain relief cover, such strain relief covers (requiring the cable to be folded over the connector cover) are not always needed in a given installation. In this event, termination of the cable to the two connector parts is accomplished simply by compressing the cable between those parts.

Electronic appliance manufacturers are employing daisy-chain harnesses to interconnect various circuit segments on a given printed circuit board, and to interconnect circuit portions of two or more circuit boards. Manufacturers are also packaging groups of circuit boards in a variety of angular positions and spaced relationships. As a result, the daisy-chain harnesses required for such appliances must have a variety of connector types oriented in a variety of positions. For example, mass termination connectors can be applied to a cable in either a first or a second orientation, such that the terminals project away from either flat cable surface. Further, a given ribbon cable harness assembly may be required to interconnect a variety of mass termination connectors of different circuit sizes, and different physical dimensions.

Several machines currently in use today for fabricating daisy-chain cable harnesses employ a movable termination head mounted for reciprocation along a track which overlies a serial succession of opposing stationary termination heads. Although connnector parts of different types can be located at each termination station, the reciprocating termination head can accommodate only one particular mating connector part (typically the cover). Connectors cannot be installed in an opposing (upside-down) direction.

If a greater variety of connector terminations is required for a given harness assembly, multiple termination stations, each having opposed termination heads can be provided in a serial array, coextensive with the cable of the harness assembly. Such arrangements are, however, quite costly due to the duplication of termination tooling involved, and in the floor space required for such machine installations. Further, in an automated arrangement, a substantial cost is involved in duplicating the feeding or loading stations for each termination station.

In an effort to provide more compact termination equipment installations, rotating carousel robots and rotating turrets have been employed. An example of a carousel robot is given in U.S. Pat. No. 4,050,764 wherein a given connector part is rotatably advanced past several tooling stations, one of which terminates the connector part to a wiring harness. The installation can accommodate only one particular connector assembly, and is not adapted for daisy-chain harness construction.

An example of a rotating turret employed in a cable termination arrangement is described in U.S. Pat. No. 4,367,575. The rotating turret carries a number of connector holders, all carrying the same connector part. The turret is stepped to bring a connector holder in alignment with a stationary tooling member holding the mating connector part. The turret arrangement increases the production rate of cable harness fabrication, and provides a convenient harness ejection arrangement by employing a second turret spaced apart from the first turret, but aligned on a common axis to operate at a unitary drum-like arrangement. Only a single connector type, with only one connector per harness is fabricated with this arrangement.

SUMMARY OF THE INVENTION

It is, therefore, an object of the present invention to provide an apparatus for fabricating a cable harness in which a common cable segment is terminated to one or more mass termination connectors.

Another object of the present invention is to provide an apparatus for fabricating a cable harness assembly wherein a variety of cable connectors can be terminated to the same cable segment.

Yet another object of the present invention is to provide a cable harness fabrication apparatus which employs a minimum number of moving parts in a space-saving compact arrangement.

Still another object of the present invention is to provide a cable fabrication apparatus for applying a variety of two-piece connectors to a common cable segment in a variety of orientations, with the connector types and orientations being quickly and easily changeable with minor modifications to a common machine arrangement.

These and other objects of the present invention are provided in an apparatus for mass terminating a plurality of insulated electrical conductors to an electrical connector having insulation displacement terminals, by inserting said conductors in corresponding terminals, said apparatus including a termination station, a loading station remote from said termination station, a turret mounted between said loading and said termination stations for stepped rotation, a first connector holder mounted to said turret adapted to receive said connector, means at the loading station for loading said connector one at a time in said first connector holder, means for rotating the turret so that the first connector holder is moved from the loading station to the termination station, means for feeding said plurality of electrical conductors to the termination station at a position immediately adjacent and aligned with said connector terminals, terminator means for inserting said conductors in said terminal to form a cable harness, and means for ejecting said cable harness from said termination station, the improvement comprising:

a flat, multi-conductor including said conductors;

said electrical connector including two mating parts, with said cable being terminated between said connector parts;

said loading means being operable to load a first connector part in said first connector holder;

a second turret mounted adjacent said termination station for selective stepped rotation;

a second connector holder disposed on said second turret adapted to receive a second connector part;

a second loading station remote from said termination station;

means at the second loading station for loading said second connector part one at a time in said second connector holder;

means for rotating the second turret so that the second connector holder is moved from the second loading station to the termination station to align said first and second connector parts in an opposed spaced-apart relationship;

said conductor feeding means is operable to selectively advance a predetermined portion of said cable between said first and second connector parts; and said termination means including means for compressing said first and second connector parts together in mating relationship to terminate said cable therebetween;

whereby a continuous succession of mating connector parts can be terminated to a continuous length of cable to form at least one cable harness.

BRIEF DESCRIPTION OF THE DRAWINGS

In the drawings, wherein like elements are referenced alike.

DETAILED DESCRIPTION OF THE PREFERRED EMBODIMENT

Figure 1:
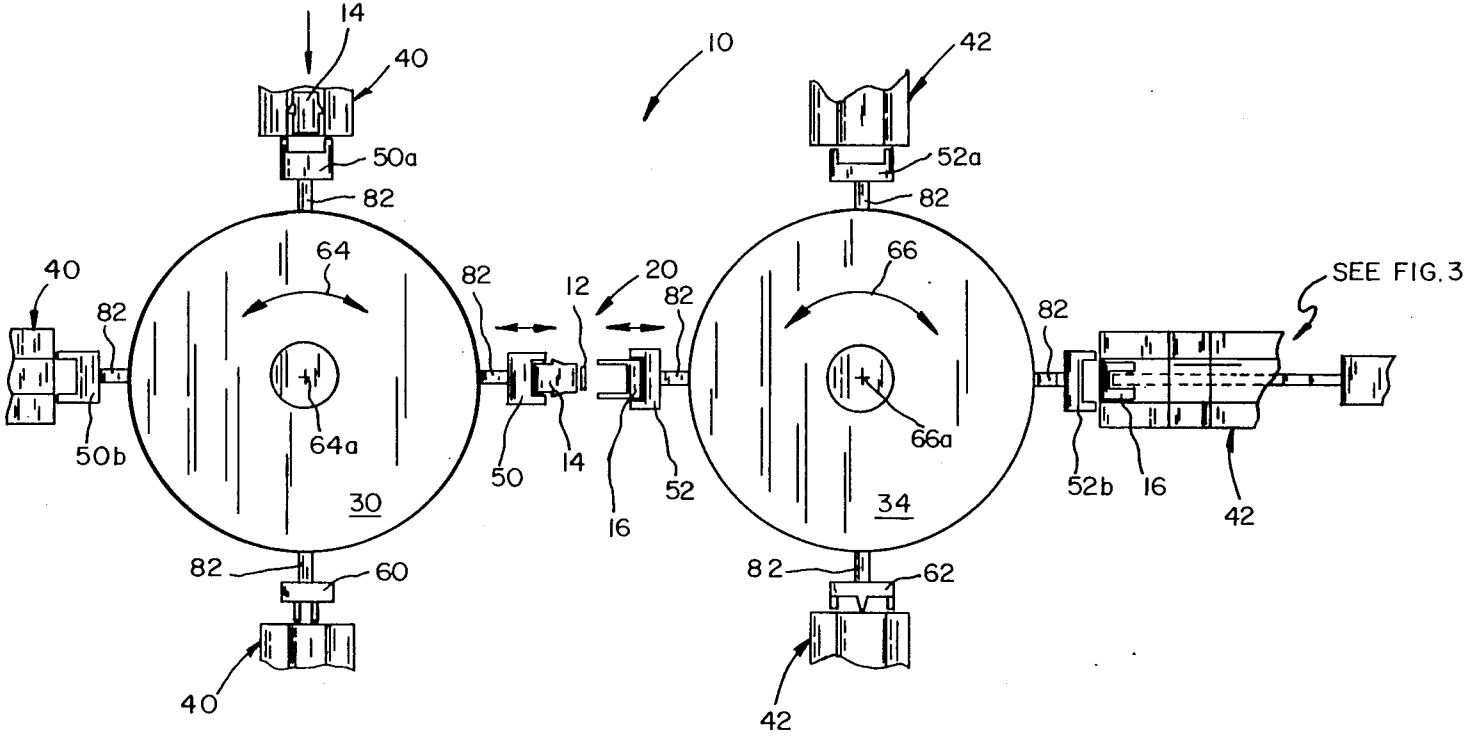
FIG. 1 is a plan view of an electrical harness fabrication apparatus according to the present invention.
Figure 2:
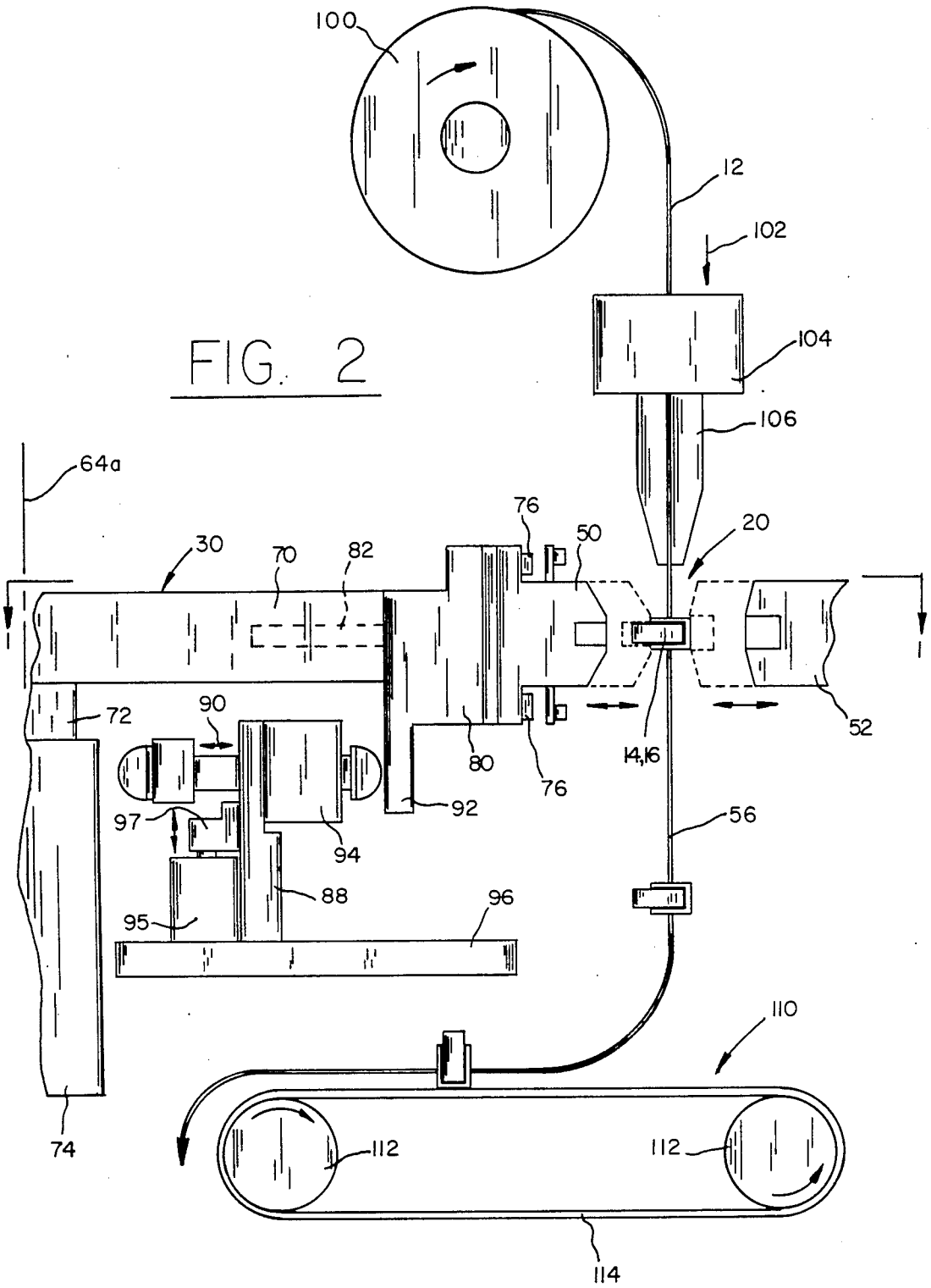
FIG. 2 is a partial elevation view of the apparatus of FIG. 1.
Figure 3:
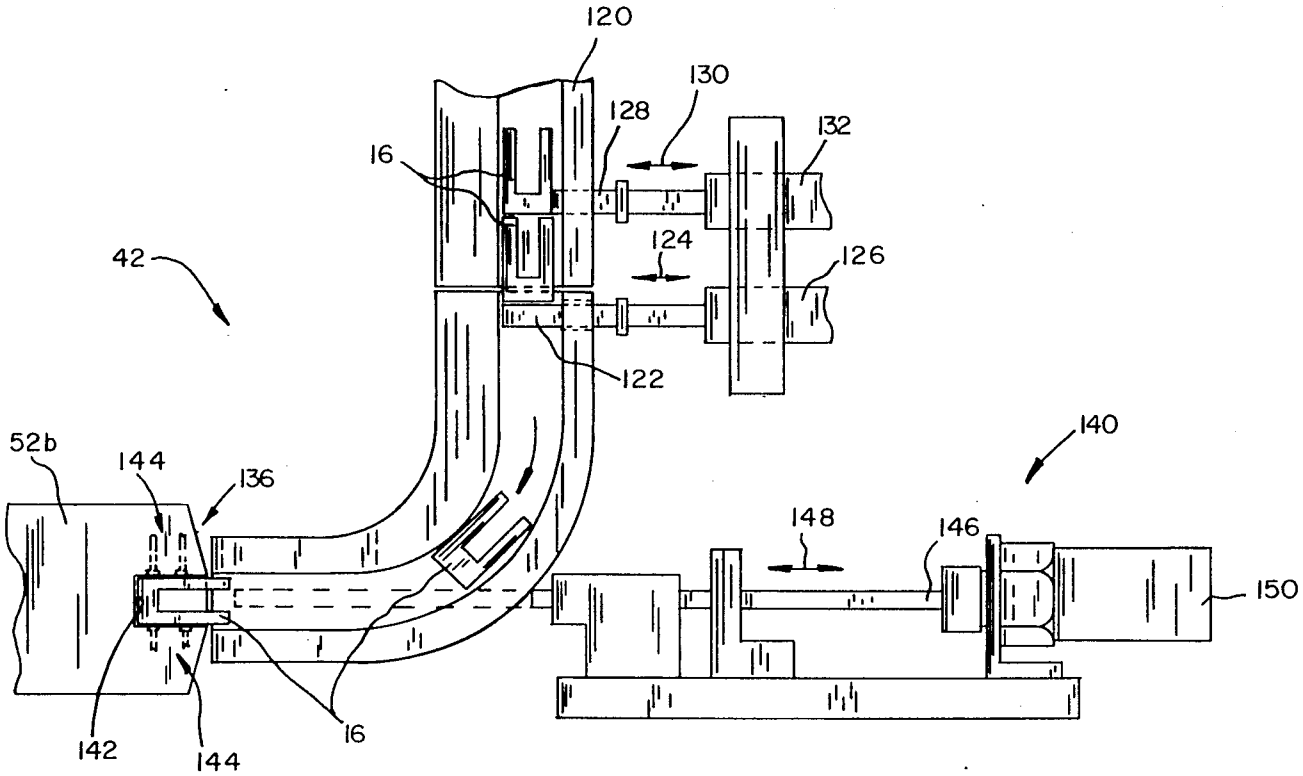
FIG. 3 is a partial elevation view of a loading station of FIG. 1 shown in greater detail.

Referring now to the drawings, and initially to FIGS. 1–3, an apparatus, generally shown at 10, is provided for mass terminating a plurality of insulated electrical conductors of a flat ribbon cable 12 to a two-piece electrical connector 14, 16 of the insulation displacement type, at a termination station 20. A pair of opposed rotating turrets 30,34 present connector parts 14,16 (taken from their respective loading stations 40,42) to the termination station 20. Connector holders 50,52 mounted on turrets 30,34 for carrying the connector parts, are moveable toward each other to compress ribbon cable 12 between mating connector parts 14,16 to form a mass terminated cable harness 56. After the cable harness is completed, turrets 30,34 are indexed to aligned cable cutoff blades 60,62 in opposed relationship at termination station 20, with the blades being similarly pressed together to sever cable 12, completing assembly of the cable harness 56.

Referring now to FIG. 1, it can be seen that turret 30 has mounted thereon a plurality of tooling stations, comprising three connector holders (**50,50*a*,50*b*), and one cutoff blade 60. The other turret 34 has a complementary arrangement of connector holders (52,52*a*,52*b*) and a cutoff blade 62. According to the present invention, an advantageous use of apparatus 10 is made by providing a loading station 40,42 for each tooling station mounted on a given turret. Thus, three loading stations 40 are provided for turret 30, and three complementary loading stations 42 are provided for turret 34**. Each loading station of a given turret preferably supplies different mating connector parts, with opposed pairs, being provided by the two turrets and their associated loading stations.

As will be explained herein, each turret 30,34 is indexable through step wise movement in either direction of rotation, about their respective axis **64*a*,64*b*, as indicated by arrows 64,66. In the preferred embodiment, turrets 30,34** are mounted for horizontal rotation. However, as will be appreciated upon examination herein, the turrets can also be mounted in other planes of rotation. For example, the turrets can be mounted in a vertical plane to conserve floor space, or can be arranged in overlying vertical relationship to conserve overall space utilization, as well as floor space.

Referring to FIGS. 1 and 2, operation and construction of a turret 30 will be described, with the understanding that turret 34 is, in the preferred embodiment, a mirror image thereof. Turret 30 is comprised of a disk-like mounting table 70 mounted for rotation about axis **64*a* on a shaft 72. Shaft 72 is in turn supported by a combination drive and control unit 74 of a conventional type known in the art to provide step-wise rotation to a drive shaft 72. With reference to FIG. 1, unit 74 is capable of rotating table 70 in either direction of rotation, as indicated by arrow 64, and in any desired step-wise amount so as to present any desired tooling station mounted on table 70 to termination station 20**.

An example of a typical tooling station is indicated in FIG. 2, wherein connector holder 50 is attached to a telescoping mounting head 80 by bolts 76. Head 80 is mounted for radially inward and outward reciprocation by a telescoping mounting shaft 82. An actuator arm 86 is mounted for reciprocation in the direction of arrow 90. The righthand free end of actuator arm 86 engages an upstanding drive ear 92 integrally formed with mounting head 80. An air cylinder 94 which drives arm 86, is mounted by block 88 to table 96. As cylinder 94 is energized, arm 86 is reciprocated in a right hand direction, displacing mounting head 80 and connector holder 50 mounted thereon, toward termination station 20. A spring arrangement, not shown in the figure, provides retraction of mounting head 80 and connector holder 50 upon deenergization of cylinder 94. Also mounted on table 96 is a second air cylinder 95 which selectively inserts gauge block 97 in the path of arm 86. This selectively limits the compression stroke to accommodate a smaller connector part, such as the cover 14. If desired, air cylinder 94 could be replaced by a conventional electrical solenoid arrangement.

Referring again to FIG. 2, cable 12 is initially stored on a reel 100 and is paid out in the downward direction of arrow 102, parallel to turret axis 64*a*. Cable 12 is advanced in the downward feed direction by a combined cable feeding and measuring unit 104 which pushes cable 12 through guide means 106 to a point adjacent termination station 20. The free end 108 of cable guide 106 is spaced sufficiently close to termination station 20 to ensure proper positioning of the cable free end, ensuring effective termination of the first connector to a given cable harness assembly. Although only one cable feeding arrangement is shown, it will be appreciated by those skilled in the art that a plurality of cable storage, feeding, measuring and guiding stations can be provided on a carousel mounted above termination station 20, to provide a plurality of different size cables at the termination station. This would allow increased flexiblity not only with respect to the type and orientation of the electrical connectors, but also with respect to the size and circuit count of the cable employed in a harness assembly.

As indicated in FIG. 2, cable harness 56, throughout its manufacture, is continually fed in a downward direction in response to gravity, and the power feed of unit 104. As each connector of the harness is terminated to a predetermined cable portion, cable 12 is downwardly advanced to present a further predetermined cable portion at termination station 20. A control system, not shown in the drawings, initiates further cable advancement in response to retraction of actuator arm 86 upon completion of the compression stroke. A conveyor arrangement 110 consisting of drive reels 112 and a conveyor belt 114 is conveniently employed to direct the free end of an elongated cable harness 56 away from the area of termination station 20. As indicated in FIG. 2, the free end of the cable harness assembly thus formed is allowed to drop off the left hand end of conveyor 110 to fall into a shipping container, a conveying tray or other suitable harness transport device. It will be readily appreciated by those skilled in the art that alternatives to the conveyor system 110 are readily available. For example, finished cable harnesses can be allowed to drop directly into a shipping container located beneath termination station 20.

Referring now to FIGS. 1-3, it will be seen that a plurality of connector loading stations are provided adjacent each turret member to allow for a variety of different connector parts to be loaded onto the same turret mechanism. An example of a typical connector loading station is shown in FIG. 3. This loading station is indicated in FIG. 1, at the right hand position of turret 34. The connector holder 52*b* as desribed above, receives a cover-like second connector part 16. A plurality of parts 16 are conveniently stacked in a vertical tube-like track or chute 120. A lower stop pin 122, mounted for reciprocation in the direction of arrow 124 by control unit 126 supports a vertical stack of connectors 16, which may be mass loaded into chute 120 using conventional techniques. A bottommost part of the vertical stack is isolated by a second upper stop pin 128 mounted for reciprocation in the direction of arrow 130 by a control unit 132. Stop pin 128 has free end which frictionally engages the connector parts.

After a vertical stack of connector parts are loaded in chute 120, and come to rest against lower stop pin 122, upper stop pin 128 is extended, so as to isolate the lowermost connector part. Thereafter, lower stop pin 122 is retracted, allowing the isolated part to slide along the bottom curved portion of chute 120 to a feeding position 136, where the free end of connector holder 52*b* is brought in close contact with the lower free end of chute 120. A pusher unit generally indicated at 140 projects connector part 16 in a leftward direction, so as to be received in a pocket 142 of connector holder 52*b*. Numeral 144 is applied to a series of retaining pins mounted in pocket 142 to retain the connector part 16 therein. Pins 144 are of a conventional spring loaded type having rounded heads to exert a gripping pressure on part 16. Pusher unit 140 can be of a type wherein compressed air is directed toward the connector holder 52*b*, so as to insert part 16 in pocket 142. In the preferred embodiment, however, pusher unit 140 comprises an armature 146 driven for reciprocation in the direction of arrow 148 by a controlled solenoid 150.

While a particular loading station 42 has been described above, conventional loading stations can be employed to telescopically insert a connector part in the pocket of a connector holder. In the preferred embodiment, multiple loading stations are provided adjacent each tool holder position, as the turret comes to rest during termination. Alternatively, additional loading stations can be provided in a two-step machine cycle—one for feeding, and one for combined termination and feeding, as described above.

Referring again to FIG. 1, operation of the harness fabrication apparatus of the present invention is initiated as cable 12 is fed to termination station 20, between tool holders 50, 52. At this point, a cable measuring arrangement is activated to identify subsequent predetermined cable positions as successive connectors are terminated to a given cable segment. Either individually, or simultaneously, turrets 30, 34 are rotated in a step-wise fashion to present a predetermined opposed, spaced-apart pair of connector parts to termination station 20, on opposing sides of cable 12. Thereafter, the termination means, air cylinder 94 is actuated to compress the two mating connector parts 14,16 together, so as to insert the conductors of cable 12 in the insulation displacing terminals contained within connector part 14. The connector holders supporting the opposed pair of connector parts 14,16 are then retracted and free end of the resulting cable harness is left unsupported as the cable feed unit 104 is activated to advance a predetermined length of cable such that a second predetermined cable portion is presented to the termination station 20. At this time (or previously, in synchronization with the compression of the connector parts) other unused connector holders of both turrets are loaded at their respective loading stations. Alternatively, an extra step in the machine cycle can be inserted so as to align a given connector holder with its loading station, and the connector holders need not be aligned with a connector loading station when a pair of connector holders are presented to termination station 20 for mating engagement with the cable.

After cable 12 is advanced, turrets 30,34 are step-wise rotated to present another opposed pair of mating connector parts 14,16 at termination station 20. Air cylinders 94 of each turret are thereafter actuated to extend their associated connector holders for compression of cable 12 between the connector parts. Upon completion of the compression stroke at termination station 20, tool holders 50,52 are retracted with the lower portion of the resulting cable harness again being left unsupported. At this time, connector parts can be loaded into and empty connector holders.

The above steps can be repeated as many times as desired to form a continuous cable harness having as many different connector configurations as may be desired. Upon termination of the final connector parts to cable 12, connector holders 50,52 are retracted, and turrets 30,34 are rotated so as to bring cable cutoff blades 60,62 in opposed relationship at the termination station 20. Thereafter, the air cylinder termination means 94 is again actuated to bring the cutoff blades together, to cut cable 12 and thereby free the completed cable harness 56 for loading into a shipping cart or the like.

Figure 4:
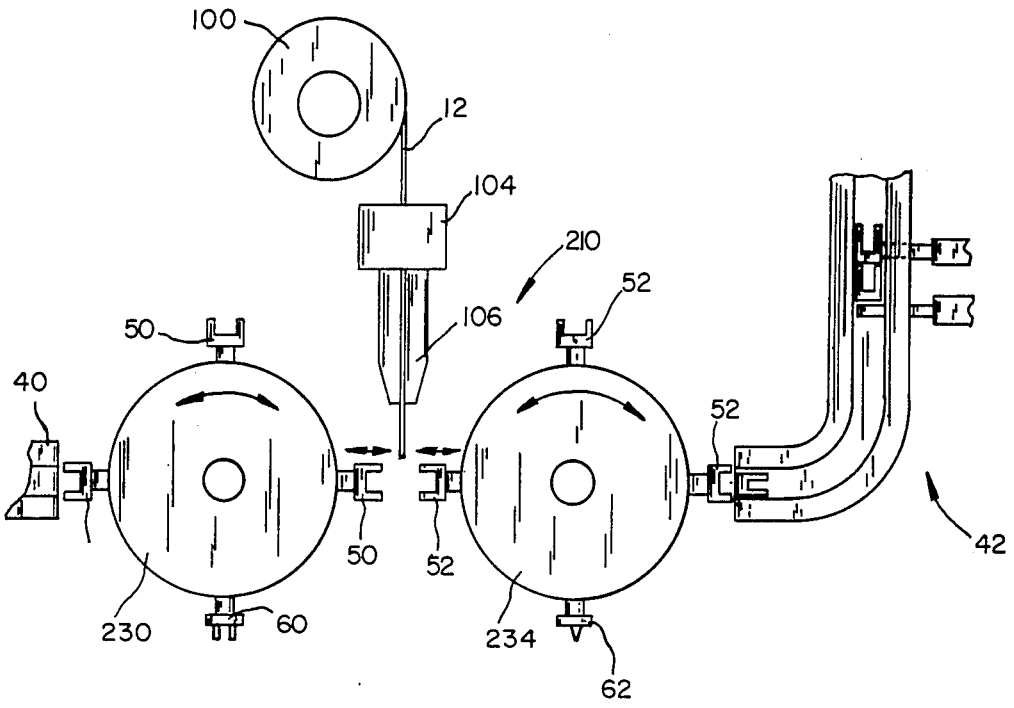
FIG. 4 is an elevation view of a first alternative embodiment according to the present invention.

Referring now to FIG. 4, an alternative embodiment of the present invention generally at 210, comprises turrets 230,234 mounted for rotation in a common vertical plane. All other features of this embodiment are identical to that described above with respect to FIGS. 1–3. The only modification needed is 90 degree displacement of the connector parts, and the connector holders from the positions of FIGS. 1–3, to account for the vertical movement of turrets 230,234. In this arrangement, the direction of cable feed is perpendicular to the axes of turret rotation whereas in the embodiment of FIGS. 1–3, it was parallel.

Figure 6:
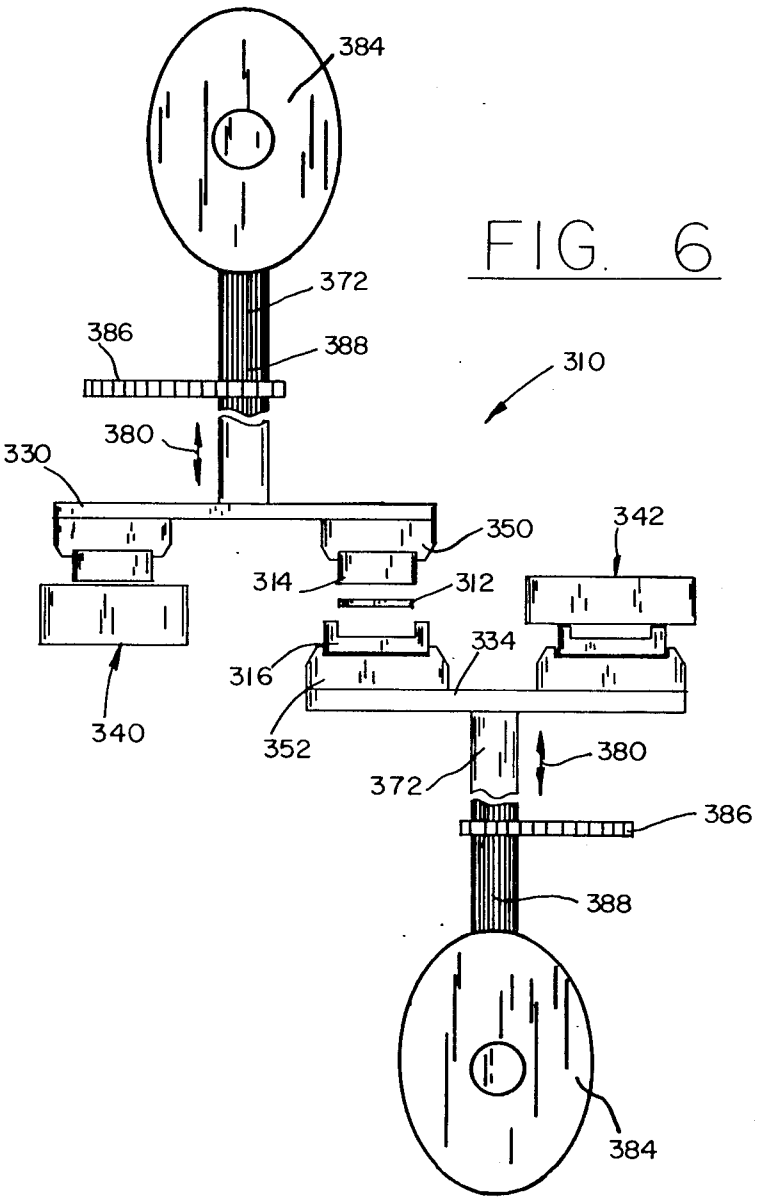
FIG. 6 is a plan view of the embodiment of FIG. 5.
Figure 5:
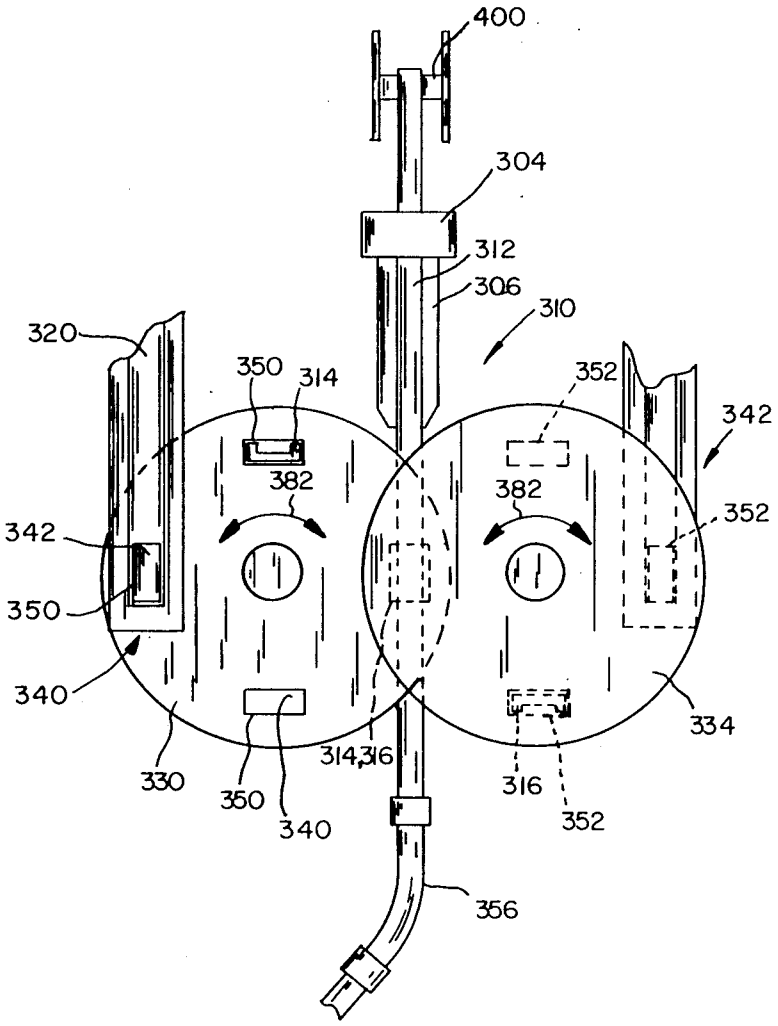
FIG. 5 is an elevation view of a second alternative embodiment according to the present invention.

Referring now to FIGS. 5 and 6, a second alternative embodiment is indicated generally at 310. In this embodiment, turrets 330,334 are arranged in overlapping vertical relationship, being mounted for axial reciprocation indicated by arrows 380, as well as bidirectional rotation indicated by arrows 382. Rotatably driven cams 384 are positioned adjacent the free ends of turret mounting shafts 372 to reciprocate turrets 330,334 in the directions of arrow 380. The turrets are rotated by drive gears 386 which engage elongated spline-like portions 388 of shafts 372.

The connector parts can be conveniently loaded into a vertically directed loading chute 320, for insertion in the pockets 342 of connector holders 352. In this embodiment, connector holders 350,352 are mounted on opposing faces of disk-like turrets 330,334.

The turrets 330,334 carry connector holders, cutoff blades, and other tools as may be necessary to provide a continuous harness assembly 356 wherein a plurality of different mating connector pairs can be terminated in different orientations to a continuous length of cable 312. The connector holders 350,352 transport mating connector parts from loading stations 340,342 to termination station 320 and the cable feed arrangement 304 positions a predetermined cable portion between mating connector parts 314,316. Thereafter, termination means of cam 384 is actuated to drive turrets 330,334 toward each other, thereby compressing cable 312 between connector parts 314,316 to terminate the cable. Thereafter, cable 312 is fed to present another predetermined portion at termination station 320, or alternatively cable cutting blades carried by turrets 330,334 may be employed to cut cable 312, thereby severing the completed cable harness 356, allowing its removal from termination station 320.

We claim:

1. In an apparatus for mass terminating a plurality of insulated electrical conductors to an electrical connector having insulation displacing terminals, by inserting said conductors in corresponding terminals, said apparatus including a termination station, a loading station remote from said termination station, a turret mounted between said loading and said termination stations for stepped rotation, a first connector holder mounted to said turret adapted to receive said connector, means at the loading station for loading said connector one-at-a-time in said first connector holder, means for rotating the turret so that the first connector holder is moved from the loading station to the termination station, means for feeding said plurality of electrical conductors to the termination station at a position immediately adjacent and aligned with said connector terminals, terminator means for inserting said conductors in said terminals to form a cable harness, and means for ejecting said cable harness from said termination station, the improvement comprising:

a flat, multiconductor cable including said conductors;

said electrical connector including two mating parts, with said cable being terminated between said two connector parts;

said loading means being operable to load a first connector part in said first connector holder;

a second turret mounted adjacent said termination station for selective stepped rotation;

a second connector holder disposed on said second turret adapted to receive a second connector part;

a second loading station remote from said termination station;

means at the second loading station for loading said second connector part one-at-a-time in said second connector holder;

means for rotating the second turret so that the second connector holder is moved from the second loading station to the termination station to align said first and said second connector parts in an opposed spaced-apart relationship;

said conductor feeding means is operable to selectively advance a predetermined portion of said cable between said first and said second connector parts; and said termination means including means for compressing said first and second connector parts together in mating relationship to mass terminate said cable therebetween;

whereby a continuous succession of mating connector parts can be terminated to a continuous length of cable to form at least one cable harness.

2. The apparatus of claim 1 wherein each of said first and said second turrets have a plurality of connector holders and at least one cable cutting fixture mounted thereon.

3. The apparatus of claim 2 wherein said connector holder includes connector-receiving pocket means at an outer periphery of one of said turrets opening outwardly toward one of said loading stations.

4. The apparatus of claim 1 wherein said terminating means comprises mounting means for movably mounting said first connector holder on said one turret and actuating means for extending said first connector holder toward said second connector holder when at the termination station.

5. The apparatus of claim 4 wherein said terminator means further comprises second mounting means for moveably mounting said second connector holder on said second turret, and second actuating means for extending said second connector towards said first connector holder when at the termination station.

6. The apparatus of claim 1 wherein said terminating means comprises mounting means for reciprocably mounting said turret for a compression stroke in a direction perpendicular to said rotation so as to extend said first connector holder toward said second connector holder when at the termination station.

7. The apparatus of claim 6 wherein the termination means further comprises second mounting means for reciprocably mounting said second turret for a compression stroke in a direction perpendicular to said second turret rotation to extend said second connector holder towards said first connector holder when at the termination station.

8. The apparatus of claim 1 wherein said one and said second turrets have parallel axes of rotation.

9. Apparatus for manufacturing a cable harness which mass terminates at least three, two-part electrical connectors to a flat multi-conductor cable disposed between each of said two connector parts, by compressing each of said two connector parts together, said apparatus comprising:

a termination station;

first and second loading stations remote from said termination station;

first and second turrets mounted between said first and second loading stations, respectively, and said termination station, for selective stepped rotation;

first and second connector holders mounted to said first and second turrets and adapted to receive said first and said second connector parts, respectively;

means at each loading station for loading said first and said second connector parts one-at-a-time in said first and said second connector holders, respectively;

means for rotating said first and said second turrets so that said first and said second connector holders are moved from their respective loading stations to the termination station, to align said first and said second connector parts in an opposed spaced-apart relationship;

cable feeding means for feeding a predetermined portion of said cable between said first and said second connector parts at the termination station;

terminator means for compressing said first and said second connector parts together in mating relationship at the termination station so as to terminate said cable; and said cable feeding means being operable in response to movement of said terminator means to selectively advance said predetermined portion of said cable beyond said termination station to present another predetermined portion of said cable for termination to another set of first and second connector parts at the termination station, whereby said three electrical connectors are sequentially terminated to a continuous length of said cable to form said cable harness.

10. The apparatus of claim 9 wherein said first and said second turrets are mounted for horizontal rotation and said cable is fed therebetween in a vertical direction.

11. The apparatus of claim 10 wherein terminated portions of said cable are advanced by gravity past said termination station during manufacture of said cable harness.

12. The apparatus of claim 11 further comprising conveyor means disposed below said first and said second connector holders to engage and convey a leading end of said cable harness during manufacture thereof to a point remote from said termination station.

13. The apparatus of claim 10 wherein said terminator means comprises means associated with said first turret for extending said first connector holder toward said second connector holder when at said termination station.

14. The apparatus of claim 13 wherein said terminator means further comprises means associated with said second turret for extending said second connector holder toward said first connector holder when at said termination staton.

15. The apparatus of claim 9 wherein each of said one and said second turrets have a plurality of connector holders and at least one cable cutting fixture mounted thereon.

16. The apparatus of claim 15 wherein said connector holder includes connector-receiving pocket means at an outer periphery of one of said turrets opening outwardly toward one of said loading stations.

* * * * *